US009780484B2

(12) United States Patent
DiFonzo et al.

(10) Patent No.: US 9,780,484 B2
(45) Date of Patent: Oct. 3, 2017

(54) MAGNETIC ARRANGEMENTS AND LABELS FOR CONNECTORS

(75) Inventors: John C. DiFonzo, Emerald Hills, CA (US); George V. Anastas, San Carlos, CA (US); David Narajowski, Los Gatos, CA (US); Bradley J. Hamel, Redwood City, CA (US); Brett William Degner, Menlo Park, CA (US); Chris Ligtenberg, Menlo Park, CA (US)

(73) Assignee: Apple Inc., Cupertino, CA (US)

( * ) Notice: Subject to any disclaimer, the term of this patent is extended or adjusted under 35 U.S.C. 154(b) by 183 days.

(21) Appl. No.: 13/584,769

(22) Filed: Aug. 13, 2012

(65) Prior Publication Data

US 2013/0210244 A1 Aug. 15, 2013

Related U.S. Application Data

(60) Provisional application No. 61/522,625, filed on Aug. 11, 2011.

(51) Int. Cl.
*H01R 11/30* (2006.01)
*H01R 13/62* (2006.01)
*H01R 43/26* (2006.01)

(52) U.S. Cl.
CPC ..... *H01R 13/6205* (2013.01); *H01R 43/26* (2013.01); *Y10T 29/49117* (2015.01)

(58) Field of Classification Search
CPC . H01R 13/6205; H01R 11/30; H01R 13/7037
USPC ..... 439/38–39
See application file for complete search history.

(56) References Cited

U.S. PATENT DOCUMENTS

| | | | | |
|---|---|---|---|---|
| 3,810,258 | A * | 5/1974 | Mathauser | 439/39 |
| 4,025,964 | A * | 5/1977 | Owens | 623/11.11 |
| 4,287,676 | A * | 9/1981 | Weinhaus | 40/661.01 |
| 4,605,292 | A * | 8/1986 | McIntosh | 359/870 |
| 4,874,316 | A * | 10/1989 | Kamon et al. | 439/39 |
| 7,264,479 | B1 * | 9/2007 | Lee | 439/39 |
| 7,311,526 | B2 * | 12/2007 | Rohrbach et al. | 439/39 |
| 7,329,128 | B1 * | 2/2008 | Awad | 439/38 |
| 7,341,458 | B1 * | 3/2008 | Koh | 439/39 |
| 7,963,773 | B2 * | 6/2011 | Palli et al. | 439/38 |
| 8,241,043 | B1 * | 8/2012 | Lin | H01R 13/6205 439/39 |
| 8,247,693 | B2 * | 8/2012 | Gober | H02G 3/14 174/66 |

(Continued)

*Primary Examiner* — Xuong Chung Trans
(74) *Attorney, Agent, or Firm* — Kilpatrick Townsend & Stockton, LLP

(57) ABSTRACT

Magnetic connectors that may be readily manufactured and provide a high landed force and labels for magnetic connectors that may protect magnets or magnetic elements in the connectors, provide an aesthetically pleasing appearance, and improve the magnetic performance of the connectors. In various examples, power and signal paths may be formed using contacts that are separate from magnets or magnetic elements, paths may be formed using magnets or magnetic elements, or paths may be formed using a combination of contacts and magnets and magnetic elements. The magnets may have various arrangements. One or more magnets may be used in conjunction with magnetic elements. The interface surface of these magnets and magnetic elements may have various contours, such as flat, spline, or involute.

45 Claims, 17 Drawing Sheets

(56) References Cited

U.S. PATENT DOCUMENTS

| | | | | |
|---|---|---|---|---|
| 8,388,353 | B2 * | 3/2013 | Kiani et al. | 439/39 |
| 8,460,008 | B1 * | 6/2013 | Lin | H01R 13/2421 439/39 |
| 8,535,088 | B2 * | 9/2013 | Gao et al. | 439/490 |

* cited by examiner

MAGNETIC ARRANGEMENTS AND LABELS FOR CONNECTORS

CROSS-REFERENCES TO RELATED APPLICATIONS

This application claims the benefit of U.S. provisional patent application No. 61/522,620, filed Aug. 11, 2011, which is incorporated by reference.

BACKGROUND

The number and types of electronic devices available to the public has increased tremendously the past few years, and this increase shows no signs of abating. Devices such as portable computing devices, tablet, desktop, and all-in-one computers, cell, smart, and media phones, storage devices, portable media players, navigation systems, monitors and other devices have become ubiquitous.

These devices often receive power and share data using various cables. These cables may have connector inserts, or plugs, on each end. The connector inserts may plug into connector receptacles on electronic devices, thereby forming one or more conductive paths for signals and power.

These inserts and receptacles may be magnetic, where an insert is held in place in a receptacle by magnetic attraction. To avoid inadvertent disconnections, it may be undesirable for an insert to be easily removed from a receptacle. Accordingly, it may be desirable to provide configurations for magnets in these connectors that provide a high holding power. To reduce costs, it may be desirable that the connectors be simple to manufacture.

Also, these connector inserts may be left in place for long periods of time. In other applications though, a cable may be disconnected from an electronic device on a regular basis. This may lead to wear, damage, or abrasions on or in the connector inserts and receptacles. For these reasons, it may be desirable to protect the connectors from wear and other damage.

A user's experience in connecting and disconnecting these cables may do a lot to inform the user's opinion of the device itself. Accordingly, it may be desirable to provide connectors that function well and provide an improved performance.

Thus, what is needed are magnet configurations for connectors that provide a high holding force and are simple to manufacture, and labels that may further improve holding power, protect the connectors, and improve connector performance.

SUMMARY

Accordingly, embodiments of the present invention may provide arrangements for magnets for connectors that have a high holding strength and are easy to manufacture, and labels that further improve holding power, protect the connectors, and improve connector performance.

Various embodiments of the present invention may provide magnetic connectors that provide various electrical pathways. In some embodiments of the present invention, paths for power and ground supplies may be provided by a magnetic connector. In other embodiments, one or more signal lines for data communication, connection detection, or other purpose, may be included. These one or more signal lines may be electronic or optical. In various embodiments of the invention, combinations of some or all of these signals may be conveyed in some or all of these ways.

In various embodiments of the present invention, these pathways may be provided using one or more contacts on a connector insert that aligns with a corresponding connector on a connector receptacle. For example, these pathways may be provided using contacts surrounded by one or more magnets or magnetic elements. In other embodiments of the present invention, the magnets or magnetic elements may be used to provide power and signal pathways. In still other embodiments of the present invention, one or more contacts and one or more magnets or magnetic elements may be used to provide power or signal pathways.

In various embodiments of the present invention, different types and numbers of magnets or magnetic elements may be used. An illustrative embodiment of the present invention may provide a magnetic connector system where one or more magnets are located in a connector receptacle, while one or more attraction plates, which may be made of a ferro-magnetic material, may be located in a corresponding connector insert. In other embodiments of the present invention, one or more magnets may be located in a connector insert and one or more attraction plates may be located in a corresponding connector receptacle. In still other embodiments, one or more magnets may be located in both a connector insert and a connector receptacle.

Embodiments of the present invention may provide connectors having magnets and magnetic elements in various arrangements. One illustrative embodiment of the present invention may provide a number of magnets, where one or more magnets include openings to allow passageways for one or more power, ground, or signal contacts. One specific embodiment provides three magnets, where a central magnet has a bay-type opening to form a passageway for one or more contacts. In another embodiment of the present invention, these three magnets may be formed using a single magnet.

In another embodiment of the present invention, one magnet may be used. Flux from the one magnet may be guided along two or more poles or magnetic elements to provide a magnetic attraction. The one magnet and magnetic elements may be located in a connector receptacle or a connector inserts. The magnetic elements may convey power or signals, or they may be electrically isolated, where separate contacts may convey power or signals.

These various arrangements may provide a high holding strength, also referred to as a high landed force. For example, the one magnet arrangement may provide a high landed force with a simple connector design.

Embodiments of the present invention may provide magnetic arrangements having various surface contours. For example, the surface may have a contour that is flat, spline, involute, rounded, or have it may have other contours.

These contours and high-landed forces may provide a connector system where a connector insert may be "blind mated" to a connector receptacle. That is, the connector insert and connector receptacle may be configured such that when the connector insert is brought into close proximity to the connector receptacle in approximately a correct orientation, the magnetic attraction between the connector insert and the connector receptacle is such that the connector insert may be pulled into contact with the connector receptacle. As part of this blind mating, the physical features of the connector insert and the connector receptacle may be such that they pose little or no obstacle to the formation of this connection. This may provide an easy way for a user to make a connection of a cable to a device. Specifically, the user merely brings the connector insert in approximately a correct orientation and into proximity of the connector receptacle. From there, the magnetic attraction between the connector insert and the connector receptacle brings them into contact.

Another illustrative embodiment of the present invention may provide a label for a magnetic connector that may protect magnets in the connector, provide an aesthetically pleasing appearance, and improve the magnetic performance of the connector.

A specific embodiment of the present invention may provide a label that protects magnets in a connector. The connector may be a connector receptacle or connector insert. This label may protect the magnets by providing a more durable surface than brittle magnets would otherwise provide. This better-wearing, more robust surface may protect the magnets from damaging impacts and abrasions. The label may have sufficient thickness to provide adequate protection for the magnets, while not being excessively thick and thereby effectively magnetically isolating the magnets.

Another illustrative embodiment of the present invention may provide a label that provides an aesthetically pleasing appearance. Various embodiments of the present invention may achieve this by hiding the magnets. In various embodiments of the present invention, the labels may have a finish that matches another part of the connector, a device housing for the device that includes the connector, or other desirable finish. For example, illustrative embodiments of the present invention may provide labels having a brushed aluminum-appearing finish, a plastic-appearing finish, or other type of finish.

Another illustrative embodiment of the present invention may provide a label for a magnetic connector that may improve connector performance by reducing an air gap between magnetic elements in a connector receptacle and connector insert. In various embodiments of the present invention, this may be achieved by forming some or all of the label from magnetically conductive material. In a specific embodiment of the present invention, an air gap between magnets in a connector receptacle and an attraction plate in a connector insert is reduced by employing a magnetically conductive label.

Another illustrative embodiment of the present invention may provide a label for a connector receptacle having a number of magnets with their poles arranged in different orientations. In a specific embodiment of the present invention, this label may be formed as a substantially contiguous piece of magnetically conductive material. This label may improve connector performance by limiting stray magnetic flux when the connector is not connected. This limited stray flux may help to reduce inadvertent attraction of magnetic material when the connector is not connected. It may also reduce the chance of inadvertent de-magnetization of credit cards and loss of other magnetic information when they are brought into proximity of the connector.

Another illustrative embodiment of the present invention may provide a label for a connector receptacle having a number of magnets with their poles arranged in different orientations. In a specific embodiment of the present invention, this label may be formed as multiple sections of magnetically conductive material, each section corresponding to a magnet. This arrangement may reduce the shorting of flux among the magnets. This may in turn increase magnetic attraction between magnetic elements in a connector receptacle and an attraction plate in a connector insert. Increasing magnetic attraction in this way may allow the use of magnets having a reduced cost or size, thereby reducing connector costs.

Embodiments of the present invention may provide labels that are formed of various materials. In a specific embodiment of the present invention, the label may be formed of magnetic steel or other magnetically conductive or ferromagnetic material. Another specific embodiment of the present invention may provide a label that is formed of a resin that contains magnetic particles.

Embodiments of the present invention may provide labels that may be attached in various ways. For example, the labels may be attached using glue or other adhesive. In other embodiments of the present invention, the labels may rely on magnetic attraction, that is, the label may be magnetically held to the magnets. In other embodiments of the present invention, labels may be held on mechanically, for example by using clips or tension between a feature on the connector and the label. In one specific embodiment of the present invention, a connector receptacle may include a mesa or raised portion on which one or more contacts may reside. A label may be fitted around the mesa, using the raised portion to hold the label in place. In still other embodiments of the present invention, the label may be formed as a coating, film, or layer over the magnets.

Embodiments of the present invention may provide labels where magnetically conductive areas are arranged in different ways. For example, when magnetic elements are used to convey power or signals, the label may have isolated magnetically (and electrically) conductive areas to avoid shorts between magnetic elements that are conveying different power supplies or signals. Magnetic elements that convey the same power supply or signal may share a conductive area. In these situations, the label both conducts electricity and is used to provide magnetic holding power.

Where the magnet elements do not convey power or signals, and instead separate contacts are used, the magnet elements may share magnetically conductive areas, or they may be separated. In other embodiments, some combination of these may be employed.

Various embodiments of the present invention may incorporate one or more of these and the other features described herein. A better understanding of the nature and advantages of the present invention may be gained by reference to the following detailed description and the accompanying drawings.

DESCRIPTION OF ILLUSTRATIVE EMBODIMENTS

Figure 1:
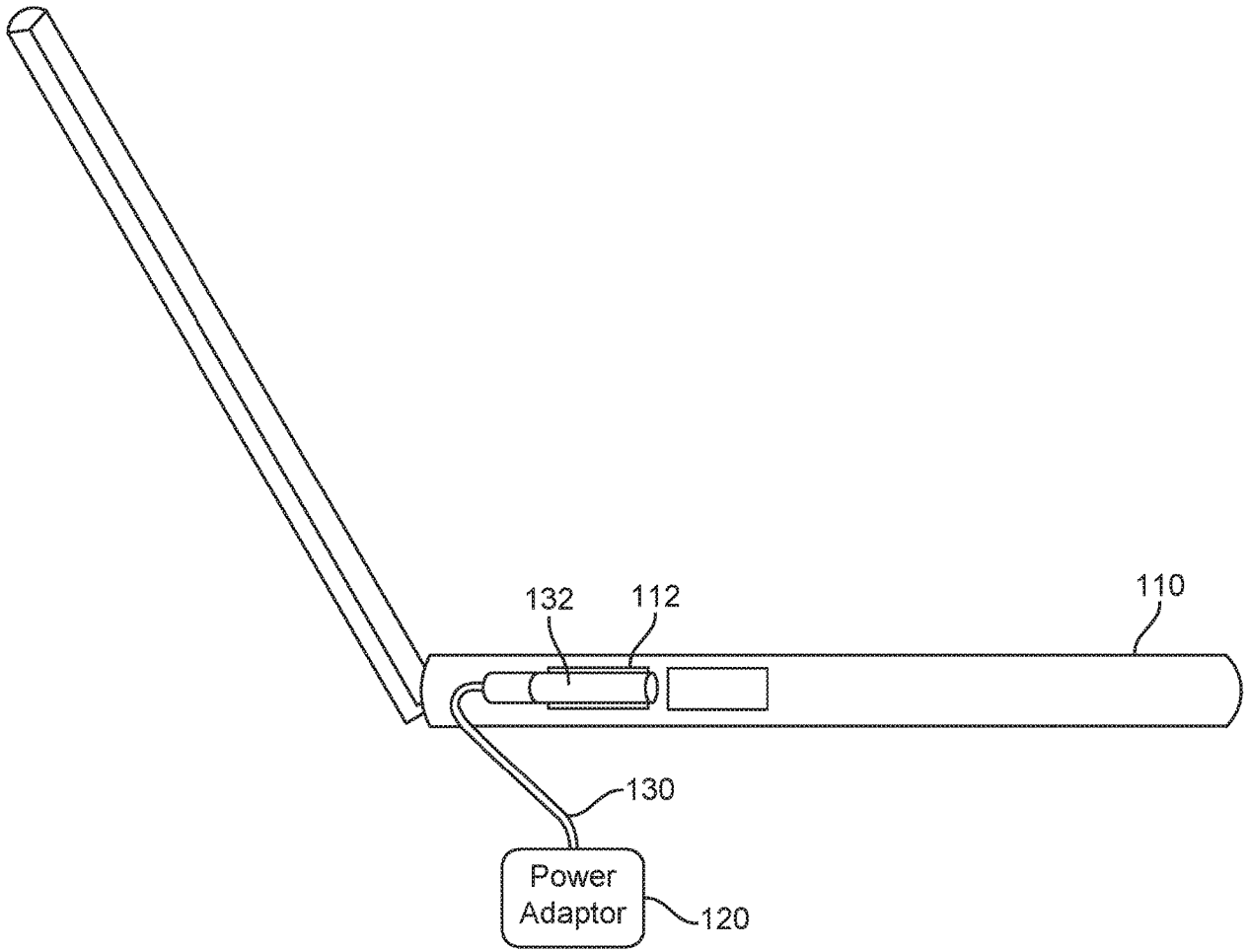
FIG. 1 illustrates an electronic system including a connector system that may be improved by the incorporation of an embodiment of the present invention.

FIG. 1 illustrates an electronic system including a connector system that may be improved by the incorporation of an embodiment of the present invention. This figure, as with the other included figures, is shown for illustrative purposes and does not limit either the possible embodiments of the present invention or the claims.

This figure includes a laptop computer 110 that may receive power from power adapter 120. Specifically, power adapter 120 may provide power to laptop computer 110 through cable 130 and a connector system, including connector insert 132 and connector receptacle 112. In various embodiments of the present invention, connector insert 132 and connector receptacle 112 may be various types of connectors. In some embodiments of the present invention, connector insert 132 and connector receptacle 112 are magnetic connectors. That is, one or more magnets may be located in one or both of connector insert 132 and connector receptacle 112. An attraction plate or other magnetically-conductive portion may be included in either or both connector insert 132 or connector receptacle 112. In a specific embodiment of the present invention, connector receptacle 112 may include one, two, three, four, or more than four magnets. Some or all of these magnets may have opposing polarities. In this specific embodiment of the present invention, connector insert 132 may include an attraction plate.

The attraction plate in connector insert 132 may be magnetically attracted to magnets in connector receptacle 112. Specifically, magnetic field lines originating in a first one of the magnets in connector receptacle 112 may pass through the attractor plate in connector insert 132 and terminate in the first one or a second magnet in connector receptacle 112.

While in this specific embodiment of the present invention electronic device 110 is a laptop computer, other electronic devices such as portable computing devices, tablet, desktop, and all-in-one computers, cell, smart, and media phones, storage devices, portable media players, navigation systems, monitors and other devices, may be improved by the incorporation of embodiments of the present invention. Also, while connector insert 132 and connector receptacle 112 convey power, in other embodiments of the present invention, connector insert 132 and connector receptacle 112 may convey data, status, control, and other types of signals, as well as bias, power, ground, and other types of voltages. For example, a connection status signal may be conveyed using these connectors. These signals and voltages may convey signals according to one or more interfaces, such as Universal Serial Bus (USB), High-Definition Multimedia Interface (HDMI), Digital Visual Interface (DVI), DisplayPort, Thunderbolt, or other types of interface.

During use, it may be desirable that connector insert 132 not be easily disconnected from receptacle 112. Accordingly, embodiments of the present invention may provide a connector system having a high holding strength or landed force. Embodiments of the present invention may further provide inserts and receptacles that are simple to manufacture.

Also, during a device's lifetime, connector insert 132 may be connected to, and disconnected from, connector receptacle 112 numerous times. This may lead to wear and damage to connector receptacle 112. Also, it may be desirable for connector receptacle 112 to have an aesthetically-pleasing appearance. Moreover, the connection and disconnection of connector insert 132 from connector receptacle 112 may go a long way in informing a user's opinion of device 110, and therefore the likelihood of the user making a similar purchase in the future. Accordingly, embodiments of the present invention may provide labels that may protect these connectors, provide an aesthetically-pleasing appearance, and improve connector performance. In various embodiments of the present invention, these labels may also limit stray flux when a connection is not made and improve holding strength or landed force when a connection is made. An example of a connector that may be improved by embodiments of the present invention is shown in the following figure.

Figure 2:
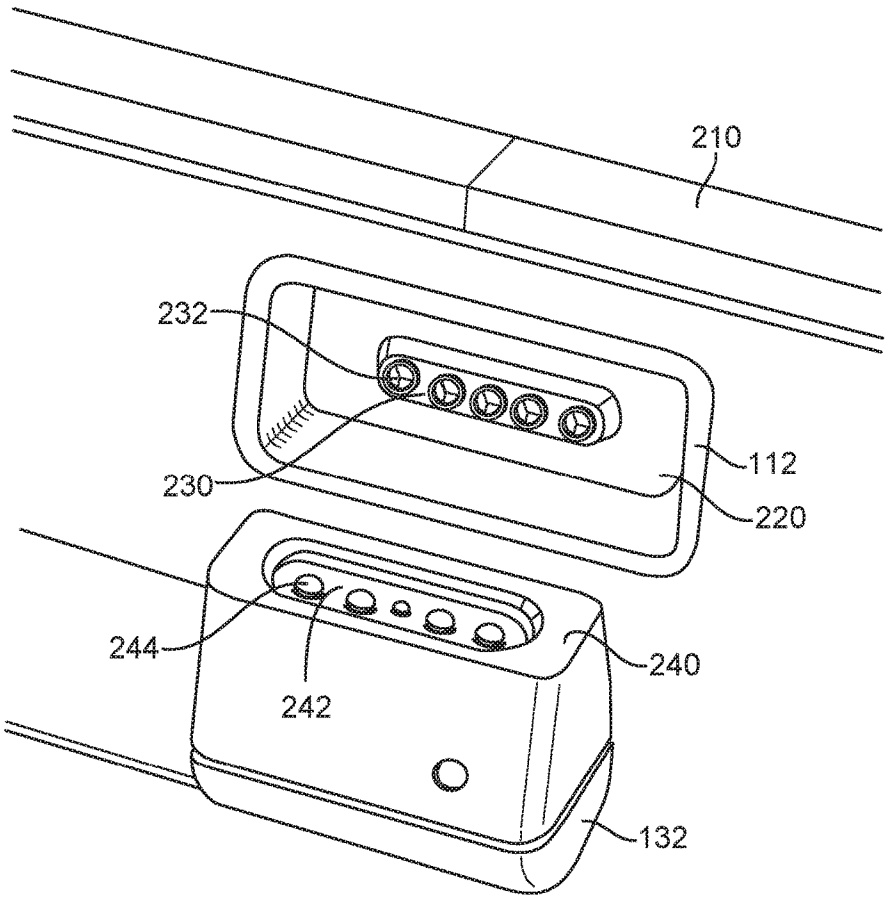
FIG. 2 illustrates a connector insert and connector receptacle according to an embodiment of the present invention.

FIG. 2 illustrates a connector insert and connector receptacle according to an embodiment of the present invention. Connector receptacle 112 may be located on housing 210 of a device. Connector receptacle 112 may include a recessed portion 220 surrounding a raised portion or mesa 230. One or more contacts 232 may be arranged on mesa 230.

Connector insert 132 may include attraction plate 240. The attraction plate 240 may surround a recessed portion 242. One or more contacts 244 may be located in recessed portion 242. One or more contacts 244 may be arranged to mate with contacts 232 when connector insert 132 is mated with connector receptacle 112. Mesa 230 on connector receptacle 112 may be arranged to fit in recessed portion 242 in connector insert 132. Attraction plate 240 on connector insert 132 may be formed to fit in recess 220 in connector receptacle 112.

Connector receptacle 112 may include one or more magnets or magnetic elements near an opening in housing 210. Specifically, one or more magnets or magnetic elements may be located at or near recessed surface 220. Left unprotected, these magnets or magnetic elements may be damaged by impacts or abrasions caused by the insertion of connector insert 132. Accordingly, embodiments of the present invention may provide a label to protect these magnets or magnetic elements. Also, since more than one magnet or magnetic elements may be used, one or more seams between magnets or magnetic elements may be visible. Accordingly, labels according to embodiments of the present invention may cover these seams so that they cannot be seen. Also, such labels may match housing 210 in appearance for an improved look.

In this example, power and signal paths may be formed over contacts 232 and 244. In other embodiments of the present invention, power and signal paths may be formed using one or more magnets or magnetic elements. In still other embodiments of the present invention, power and signal paths may be formed using contacts and magnets or magnetic elements. An example where magnets or magnetic elements are used to convey signals is shown in the following figure.

Figure 3:
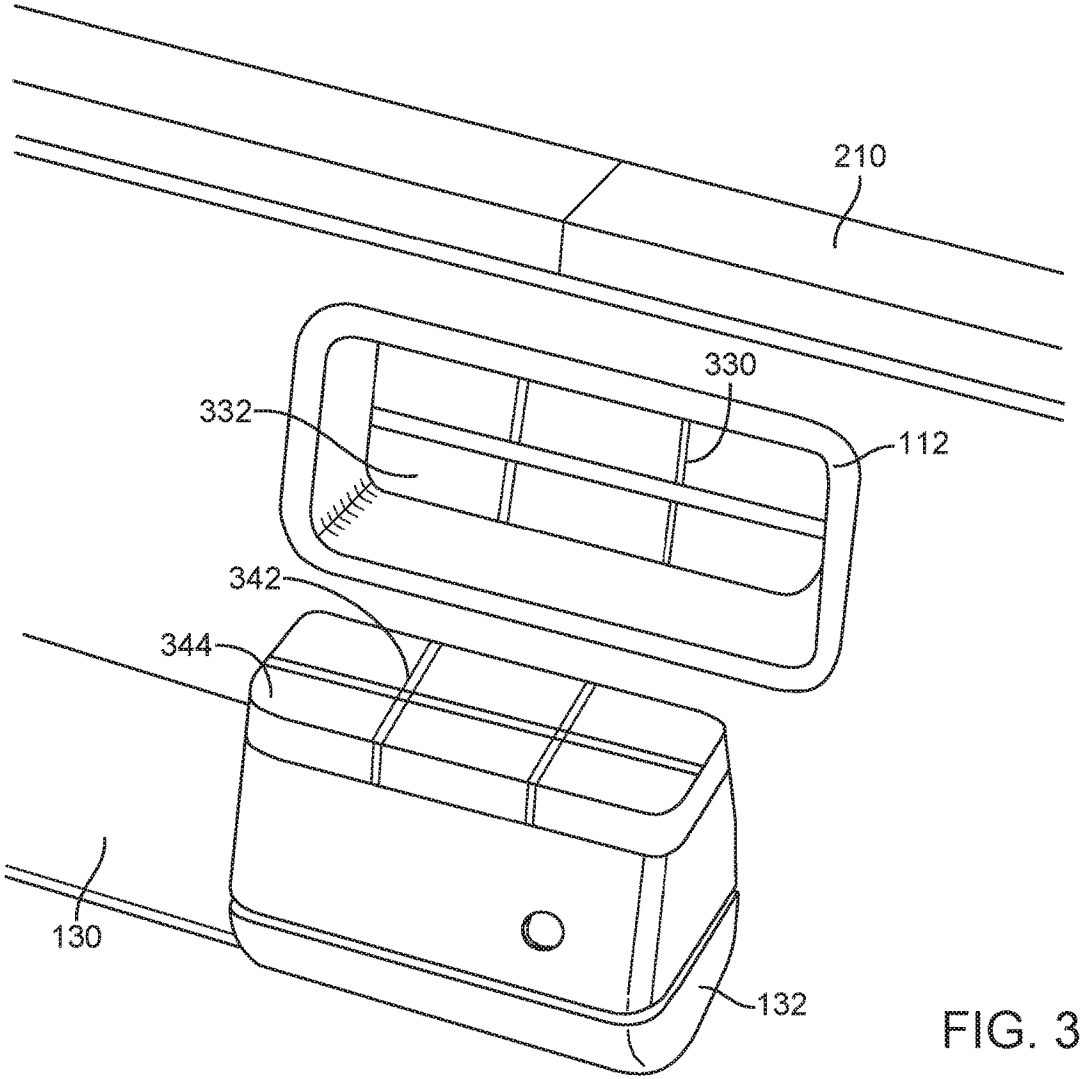
FIG. 3 illustrates another connector insert and connector receptacle according to an embodiment of the present invention.

FIG. 3 illustrates another connector insert and connector receptacle according to an embodiment of the present invention. Connector receptacle 112 may be located on housing 210 of an electronic device. Connector receptacle may include one or more magnets or magnetic elements 332. These magnets or magnetic elements 332 may convey power or signals. Magnets or magnetic elements 332 may be isolated by isolation areas 330. A label (now shown) may cover one or more magnets or magnetic elements 332 for protection and to increase holding power and reduce stray flux.

Connector insert 132 may include magnets or magnetic elements 344, which may be separated by isolation areas 342. Magnets or magnetic elements (or attraction plates) 344 may be arranged to mate with magnets or magnetic elements 332 of receptacle 112 when insert 132 is mated with receptacle 112. Also, magnets or magnetic elements 344 may be arranged to fit in the recess in receptacle 112 when insert 132 is mated with receptacle 112.

Embodiments of the present invention may further improve the performance of these connector systems by providing a magnetically-conductive label. By making some or all of the label magnetically conductive, an air gap between magnets in receptacle 112 and the attraction plate 240 in connector insert 132 may be reduced. This label may thus reduce stray flux when a connection is not made, and may improve the landed force when a connection is made between insert 132 and receptacle 112. An example of a connector system according to an embodiment of the present invention that employs such a label is shown in the following figure.

Figure 4:
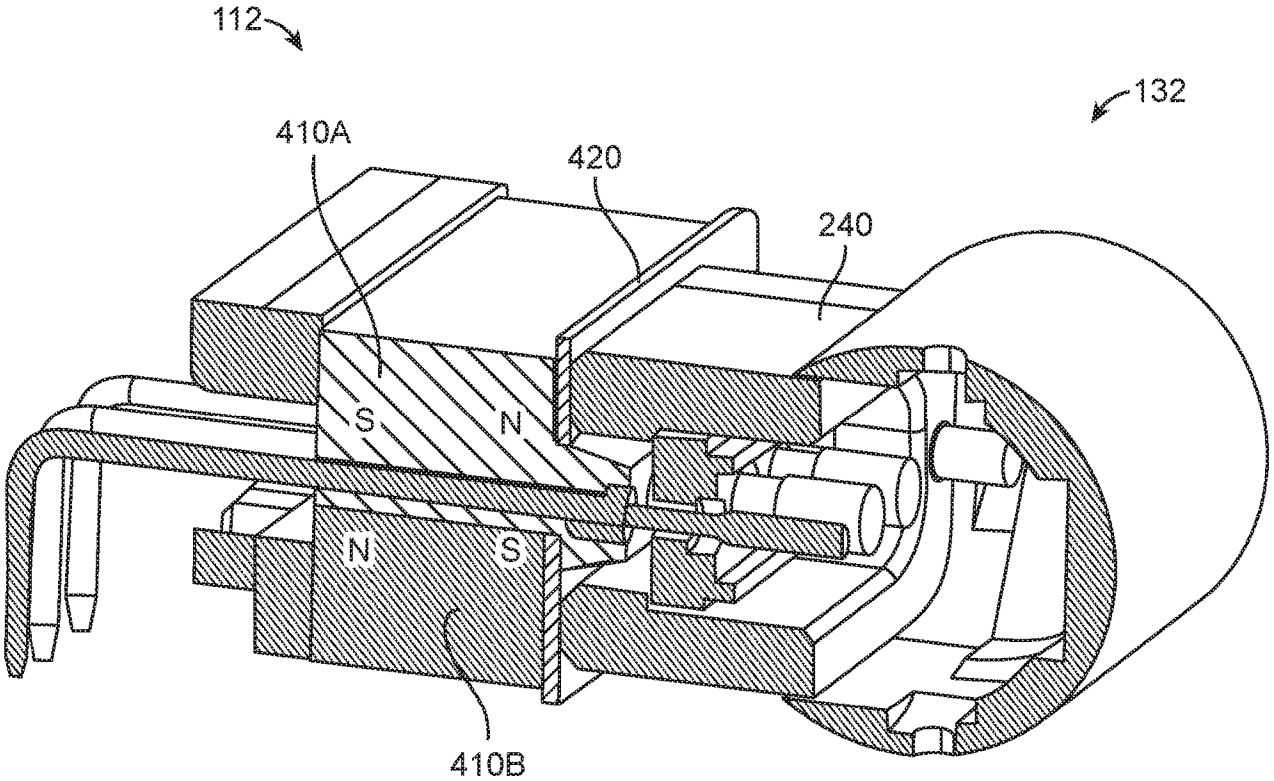
FIG. 4 illustrates a side view of a magnetic connector system according to an embodiment of the present invention.

FIG. 4 illustrates a side view of a magnetic connector system according to an embodiment of the present invention. This magnetic system includes portions of connector insert 132 and connector receptacle 112. Connector receptacle 112 may include one or more magnets 410, which may be covered by label 420. Connector insert 132 may include an attraction plate 240. Magnetic field lines originating in magnet 410A may pass through label 420 and attraction plate 240 and terminate in second magnet 410B.

More specifically, magnetic field lines originating in a North pole of magnet 410A may pass through label 420 and attraction plate 240 and terminate at a South pole of magnet 410B. In various embodiment of the present invention, magnets 410A and 410B may be formed of various materials, such as NdFeB, N50, or N52. Again, they may be arranged in various configurations. Examples of some arrangements are shown in the following figure.

Figure 5:
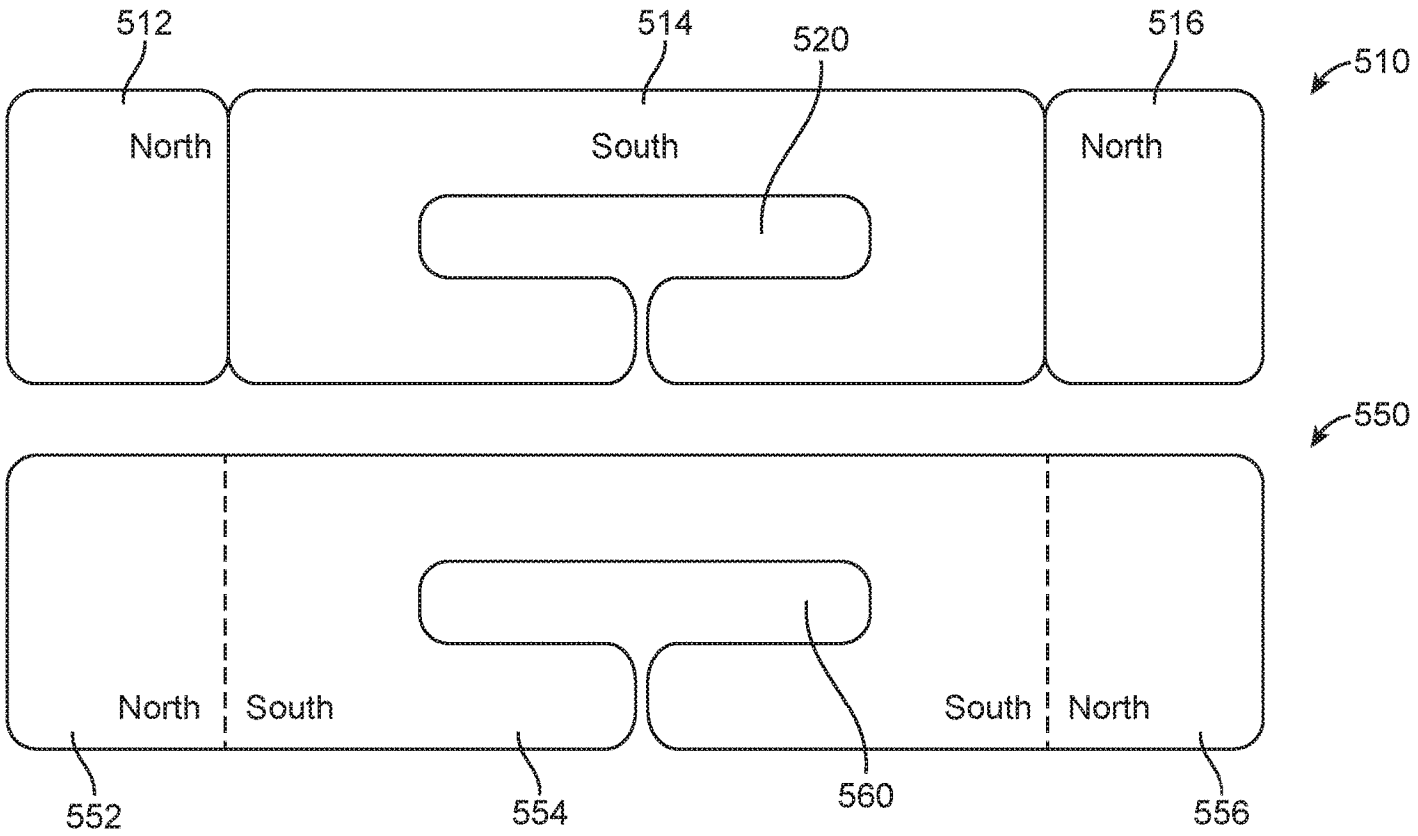
FIG. 5 illustrates two arrangements of magnets according to embodiments of the present invention.

FIG. 5 illustrates two arrangements of magnets according to embodiments of the present invention. Magnetic arrangement 510 includes magnets 512, 514, and 516. These magnets may be arranged in a linear fashion as shown. The polarities of these magnets may alternate, for example, North, South, and then North again. Magnet 514 may include bay 520. Bay 520 may provide a passage for one or more contacts to form electrical connections. Magnets 512, 514, and 516 may also be used to form electrical connections. In various embodiments of the present invention, these magnets may be located in either or both a connector receptacle and a connector insert.

Magnetic arrangement 560 includes magnetic portions 552, 554, and 556. Magnetic portions 552, 554, and 556 may be formed of a single piece. Magnetic portion 554 may include bay 560. Bay 560 may provide a passage for one or more contacts to form electrical connections. Magnetic portions 552, 554, and 556 may also be used to form an electrical connection. In various embodiments of the present invention, these magnet portions may be located in either or both a connector receptacle and a connector insert.

In various embodiments of the present invention, a single magnet may be used in conjunction with magnetic elements. These magnetic elements may be formed using a ferromagnetic material. These designs may provide a connector system that is readily manufactured and provides a high-landed force. They may also include a label as shown above. An example is shown in the following figure.

Figure 6:
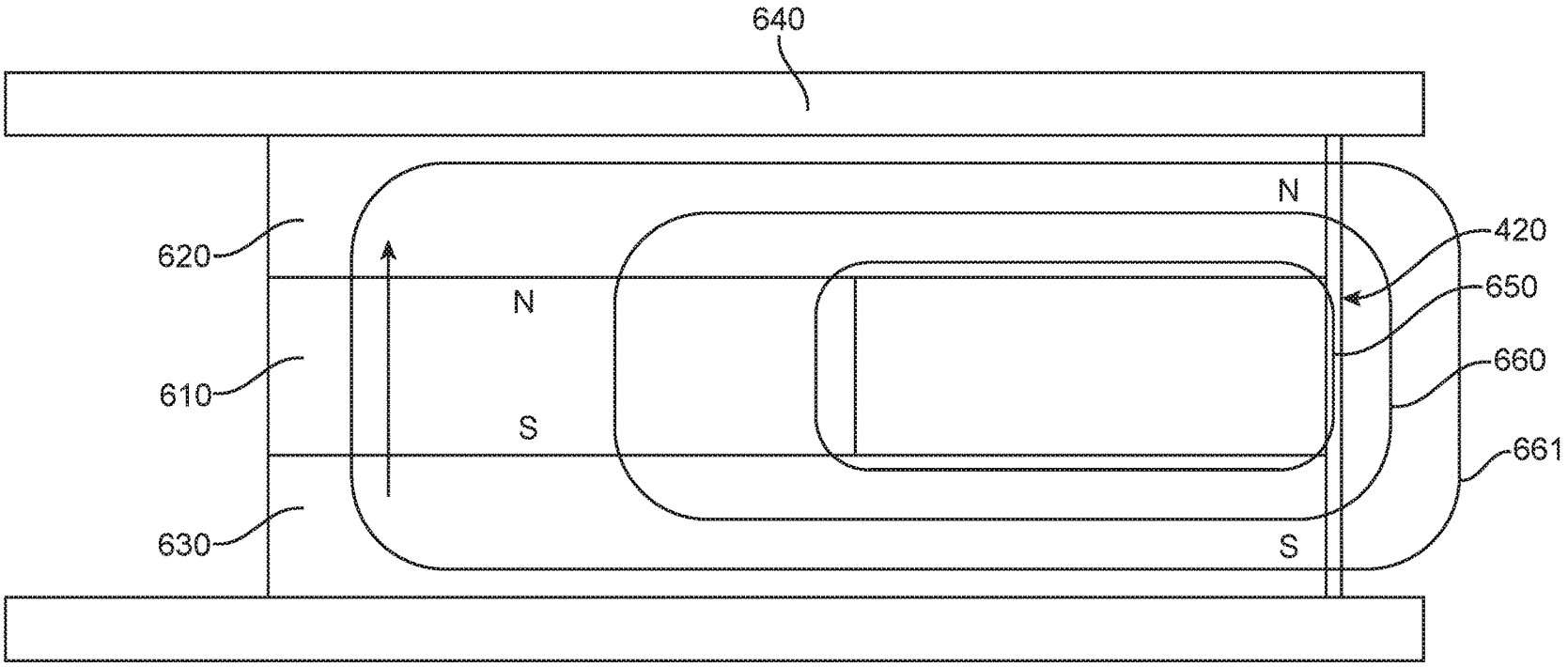
FIG. 6 illustrates a portion of a connector according to an embodiment of the present invention.

FIG. 6 illustrates a portion of a connector according to an embodiment of the present invention. This arrangement may be used in either connector receptacles or connector inserts, or both, consistent with embodiments of the present invention. In this example, a single magnet 610 is employed. A first magnetic element 620 may extend from a North side of magnet 610 to an opening, which in this case is covered by label 420. A second magnetic element 630 may extend from a South side of magnet 610 to the opening. Magnetic field lines originating at a North side of magnet 610 may pass through magnetic element 620, through the opening, through the second magnetic element 630, to the South side of magnet 610. Some of the flux at the opening may pass through label 420. This flux is shown as flux 650. Other flux, shown here as flux 660 and 661, may pass through the air in front of the opening. The structure may be at least partially located in housing 640. Again, this configuration may provide a simple magnetic connector that is readily assembled. This configuration may also provide a high-landed force.

In this example, a magnet 610 is used. In this and other embodiments of the present invention, the included magnet may generally be thought of as a magnetic flux source. Accordingly, other magnetic flux sources, such as electromagnets, and other structures presently available or available in the future may be used as magnetic flux sources.

Again, embodiments of the present invention may provide paths for power and ground. They may instead provide paths for other signals, such as communication or connection detection signals. They may also provide paths for some combination of power, ground, and signals. Again, these signals may be conveyed (provided or received) using contacts, magnets, magnetic elements, or some combination thereof. In these examples, contacts may be located completely or at least partially between the magnet 610 and the opening in the housing 640, and between the first magnetic element 620 and the second magnetic element 620. In other embodiments of the present invention, contacts may be located elsewhere.

In other embodiments of the present invention, the first magnetic element 620 and the second magnetic element 630 may provide paths for power and ground. In this case, when a corresponding connector makes contact, current may flow through the first magnetic element 620 and the second magnetic element 630. In still other embodiments of the present invention, contacts may be included and one or more power, ground, and signals may be conveyed by one or more of the first magnetic element 620 and the second magnetic element 630.

Figure 7:
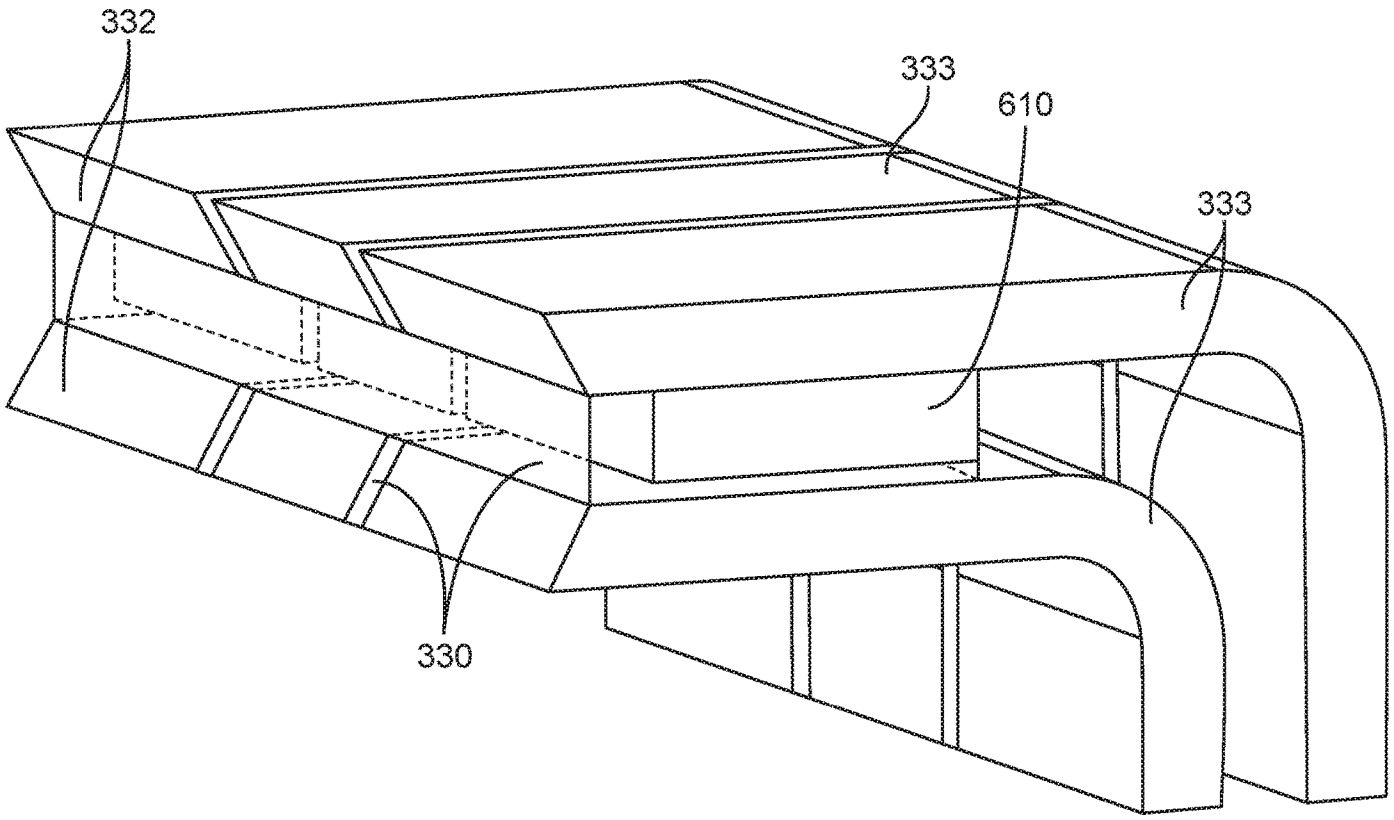
FIG. 7 illustrates an oblique view of magnets and magnetic elements that may be employed by a connector receptacle according to an embodiment of the present invention.

FIG. 7 illustrates an oblique view of magnets and magnetic elements that may be employed by a connector receptacle according to an embodiment of the present invention. This figure includes one or more magnets 610 and one or more magnetic elements 333 that provide surfaces for contacts 332. An insulating layer 330 may insulate various magnetic elements 333 from each other and from magnets 610. Magnetic elements 333 may be used to convey power and ground. Magnetic elements 333 may also be used to convey one or more signals, such as signals for communication, connection detection, or for other purposes.

In a specific embodiment of the present invention, magnetic elements 333 may form contacts in a connector receptacle, such as contacts 332 in connector receptacle 112, though they may form contacts in a connector insert. In this specific embodiment of the present invention, these contacts may convey power and ground. A signal may also be included. In one arrangement, the top row of contacts 332 may be used, in order (either right-to-left, or left-to-right), for power, signal, and ground. The lower row of contacts 332 may be used, again in order, for ground, signal, and power. In this arrangement, each power and ground contact and corresponding magnetic elements 332 should be electrically isolated from each other, for example by insulating layer 330. This arrangement may provide an advantage in that a corresponding connector insert may be inserted in one of two possible orientations while still making a proper electrical connection.

In other embodiments of the present invention, a top row of contacts to 332 may be used, in order, for power, signal, and ground. The lower row of contacts 332 may be used, again in order, for power, signal, and ground. In this arrangement, corresponding power, signal, and ground contacts do not need to be isolated from each other. Unfortunately, in this arrangement, a connector insert may either be inserted only one way, or the receptacle needs to detect the polarity of the connection made and adjust accordingly.

In still other embodiments of the present invention, contacts for conveying one or more of power, ground, or signals may be completely or at least partially located between the magnet or magnets 610 and a front of the connector (though they may extend beyond the front of the connector), and between the magnetic elements 333. In other embodiments of the present invention, these contacts may be located elsewhere in the connector. These contacts may be arranged in a row, as in FIG. 2, or they may have other configurations.

In one specific embodiment of the present invention, more than one magnet, for example, three magnets 610, may be used, as shown. In other embodiments of the present invention, other numbers of magnets, for example, two, four, or more than four magnets and corresponding magnetic elements may be used. These magnets may be at least approximately aligned with the various contacts 332. Magnets 610 may be arranged in an alternating North-South-North, or South-North-South arrangement. This may make the corresponding two rows of contacts 332 to have the same alternating arrangement, that is, one row may have a polarity of North-South-North, while the other has a polarity of South-North-South. As in each of these examples, contacts 332 may be actual contacts to convey power, ground, signals, or some combination thereof. In such a configuration, these elements may be used both for magnetic hold, as well as to convey power, ground, and signals.

In other embodiments of the present invention, contacts 332 may be used for magnetic hold, while other contacts, which again may be located between rows of contacts 332 or at other locations, may be used for power, ground, signals, or some combination thereof. For example, contacts, such as those shown in FIG. 2, may be included. Other features, such as mesa 230 in FIG. 2, may be included as well. In still other embodiments, other combinations that use contacts 332 as well as other contacts may be employed. For example, contacts 332 may be used for power and ground, while separate signal contacts may be included, for example between rows of contacts 332.

Figure 8:
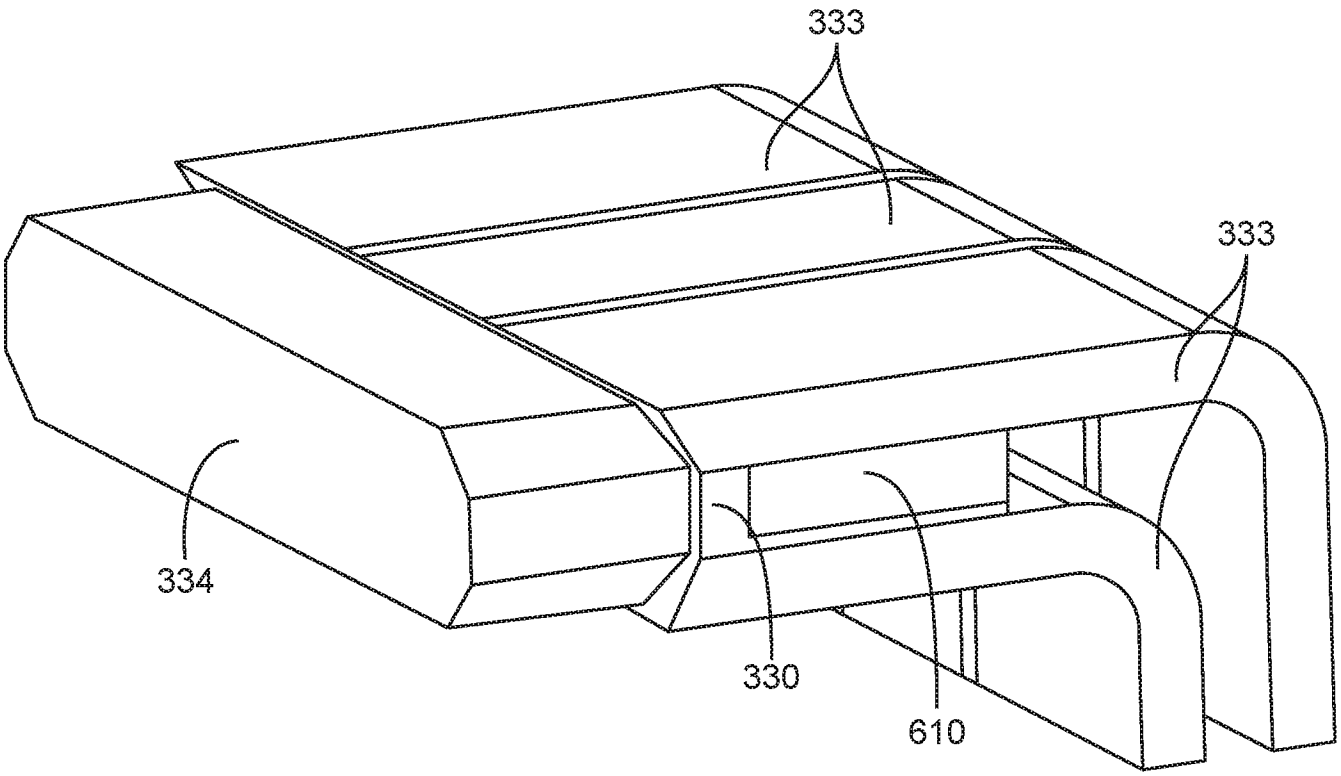
FIG. 8 illustrates the magnets and magnetic elements of FIG. 7 connecting to a magnetic element or attraction plate.

FIG. 8 illustrates the magnets and magnetic elements of FIG. 7 connecting to a magnetic element or attraction plate 344.

In various embodiments of the present invention, the surfaces formed by contacts 332 and insulating layer 330 may have various shapes or contours. For example, this shape may be flat. In the examples shown in FIGS. 7 and 8, the surface may have a spline or involute contour. These shapes may assist in preventing binding between a connector insert in a connector receptacle. These shapes may further assist in blind mating between a connector insert and a connector receptacle.

Again, embodiments of the present invention may provide a connector system where a connector insert may be "blind mated" to a connector receptacle. That is, the connector insert and connector receptacle may be configured such that when the connector insert is brought into close proximity to the connector receptacle in approximately a correct orientation, the magnetic attraction between the connector insert and the connector receptacle is such that the connector insert may be pulled into contact with the connector receptacle.

This may provide an easy way for a user to make a connection of a cable to a device. Specifically, the user may simply bring the connector insert in approximately a correct orientation and into proximity of the connector receptacle. From there, the magnetic attraction between the connector insert and the connector receptacle may bring them into contact.

To facilitate this blind mating, the physical features on the connector insert and connector receptacle may be such that there may be few or no obstacles to the formation of the connection. For example, the opening on attraction plate 240 of connector insert 132 may be such that it readily accepts mesa 230 on connector receptacle 112. Similarly, attraction plate 240 (or contacts 344) of connector insert 132 may be such that it readily fits in the opening of receptacle 112.

Again, embodiments of the present invention may provide a label over a surface of these various magnets or magnetic elements. These labels may improve the durability, appearance, and functionality of connector systems. An example of label 420 is shown in the following figure.

Figure 9:
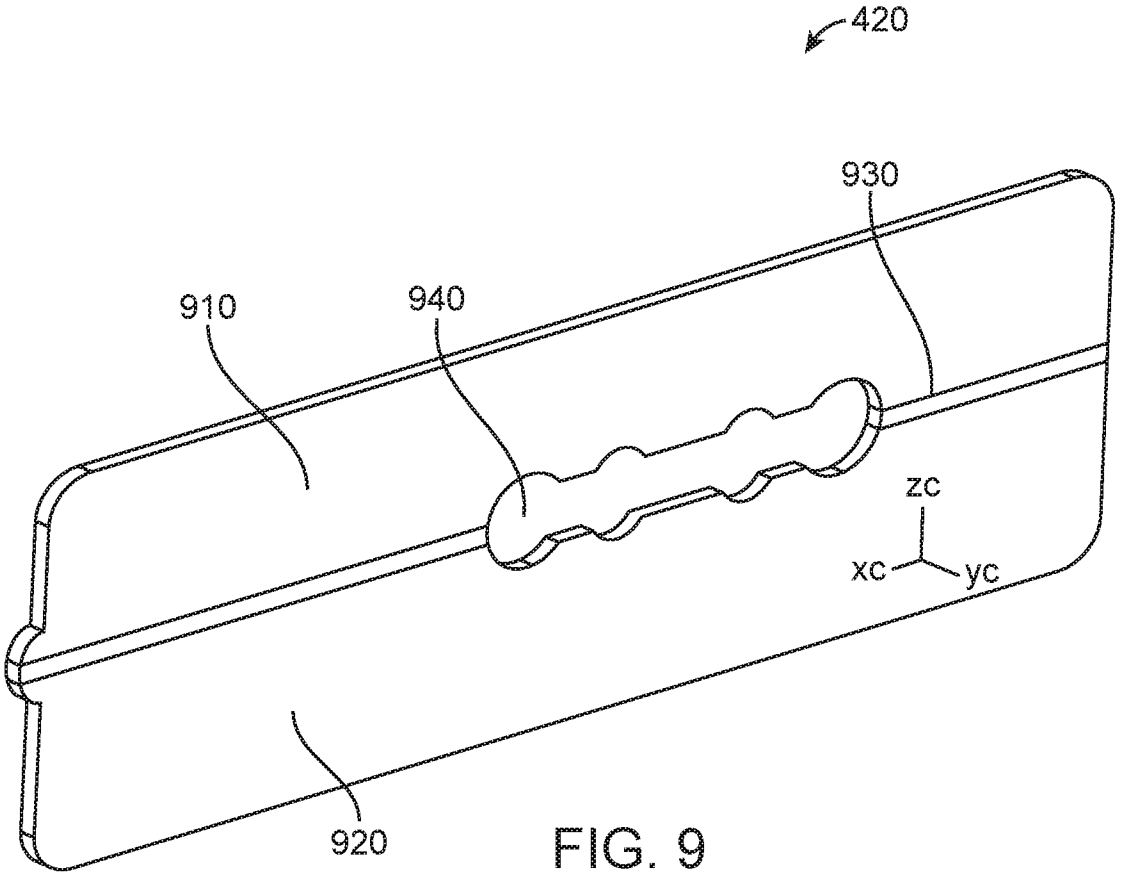
FIG. 9 illustrates a label according to an embodiment of the present invention.

FIG. 9 illustrates a label according to an embodiment of the present invention. In one embodiment of the present invention, a substantial portion of label 420 may be formed of a contiguous piece of magnetically conductive material. In other embodiments of the present invention, label 420 may include one or more magnetically conductive portions separated by non or less-magnetically conductive areas or dividers.

In the example shown, label 420 includes upper magnetically conductive portion 910 and lower magnetically conductive portion 920. Upper magnetically conductive portion 910 may be at least approximately aligned with magnets 410A in FIG. 4, while lower magnetically conductive portion 920 may be at least approximately aligned with magnet 410B in FIG. 4. A magnetically less conductive portion 930 may isolate upper magnetically conductive portion 910 from lower magnetically conductive portion 920. One or more openings, such as opening 940, may be included to allow passage of contacts or contact structures, such as mesa 230 in FIG. 2.

In various embodiments of the present invention, three, four, or more magnets or magnetic elements may be employed by connector receptacle 112. In such cases, label 420 may be subdivided further into smaller magnetically conductive areas. For example, label 420 may be arranged to have four magnetically conductive areas. In a specific embodiment of the present invention, one of these areas may be located in each corner of label 420. When label 420 covers a connector such as the connector shown in FIG. 7 and the contacts 332 convey power, ground, and signals, or some combination thereof, label 420 may be arranged to have six (or some other appropriate number) magnetically conductive areas that are electrically isolated from each other. When label 420 covers a connector such as the connector in FIG. 7 and the contacts 332 are used for magnet hold but not to convey power, ground, and signals, or some combination thereof, label 420 may be arranged to have two magnetically conductive areas that are electrically isolated from each other. In other embodiments, label 420 may be formed as a single magnetically conductive area, where the opening may have an opening for a mesa or contacts, such as mesa 230 in FIG. 2. These one or more electrically isolated conductive areas may thus form paths for power, ground, signals, or a combination thereof. Accordingly current may flow through the label when power, ground, or other signals are actually conveyed. Similarly, when the label covers a number of magnets and the magnets are used to convey power, ground, or signals, current may flow through the label. In such a situation, the label may be used for both its magnetic hold and current carrying capability.

Again, in other embodiments of the present invention, magnetically less conductive portion 930 may be absent, and magnetically conductive portions 910 and 920 may be joined as a single magnetically conductive area. Such a label may be used where the magnets or magnetic elements are not used to convey more than one power, ground, or signal line. Again, label 420 may also include opening 940, for example, to allow passage of one or more contacts, such as contacts 232 in FIG. 2. Opening 940 may be arranged to accept or fit over mesa 230, as shown in FIG. 2. In other embodiments of the present invention, opening 940 may be absent.

In various embodiments of the present invention, label 420 may be formed of various materials. For example, label 420 may be formed of steel, such as magnetic steel, or other ferro-magnetic material. In another embodiment of the present invention, label 420 may be formed of a resin that may contain magnetically conductive particles. For example, label 420 may be formed of a polycarbonate with iron powder. Magnetically less conductive portion 930 may be formed by an absence of such particles.

Again, label 420 may have an appearance to match a device housing, such as device housing 210 in FIG. 2. In other embodiments of the present invention, other finishes or appearances may be used.

Label 420 may be a fixed to magnets 410A and 410B in various ways. For example, label 420 may be glued or held to magnets 410 using an adhesive. In other embodiments of the present invention, label 420 may be magnetically held to magnets 410A and 410B. In other embodiments of the present invention, opening 940 may fit snugly around mesa 230, such that label 420 is held in place. In still other embodiments the present invention, other mechanisms, such as clips, may be used to fix a label 420 in place. In still other embodiments of the present invention, the label may be formed as a coating, film, or layer over the magnets.

By forming label 420 from magnetically conducive material, an air gap between magnets 410A and 410B and attraction plate 240 is reduced. This may increase hold power of the magnets and improve connector performance, particularly compared to using a non-magnetically conductive label.

Again, in various embodiments of the present invention, label 420 may be at least substantially formed of a magnetically conductive material. Such a label may limit stray flux present near an opening of a connector receptacle. This may help to avoid magnetic attraction of stray magnetically conductive particles. Also, limiting stray flux may protect credit card and other magnetically stored information. Further, by forming label 420 from a magnetically conductive material, an air gap that may otherwise exist (if label 420 is non-magnetic) is reduced or eliminated. This may increase a holding power of magnets 410A and 410B. By increasing the hold power of magnets 410A and 410B, magnets 410A and 410B may be made smaller, or less-expensive magnets may be used. An example is shown in the following figures.

Figure 10A:
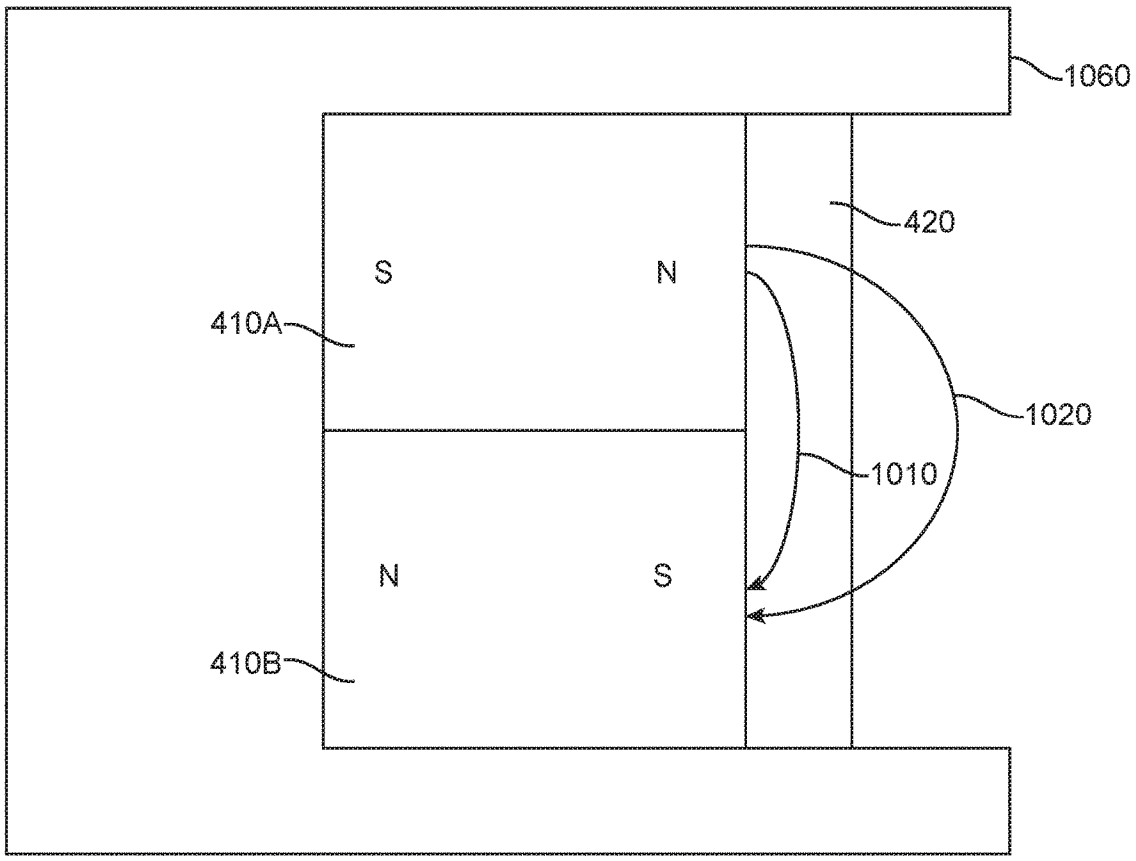
FIGS. 10A and 10B illustrate the operation of a magnetic label according to an embodiment of the present invention.
Figure 10B:
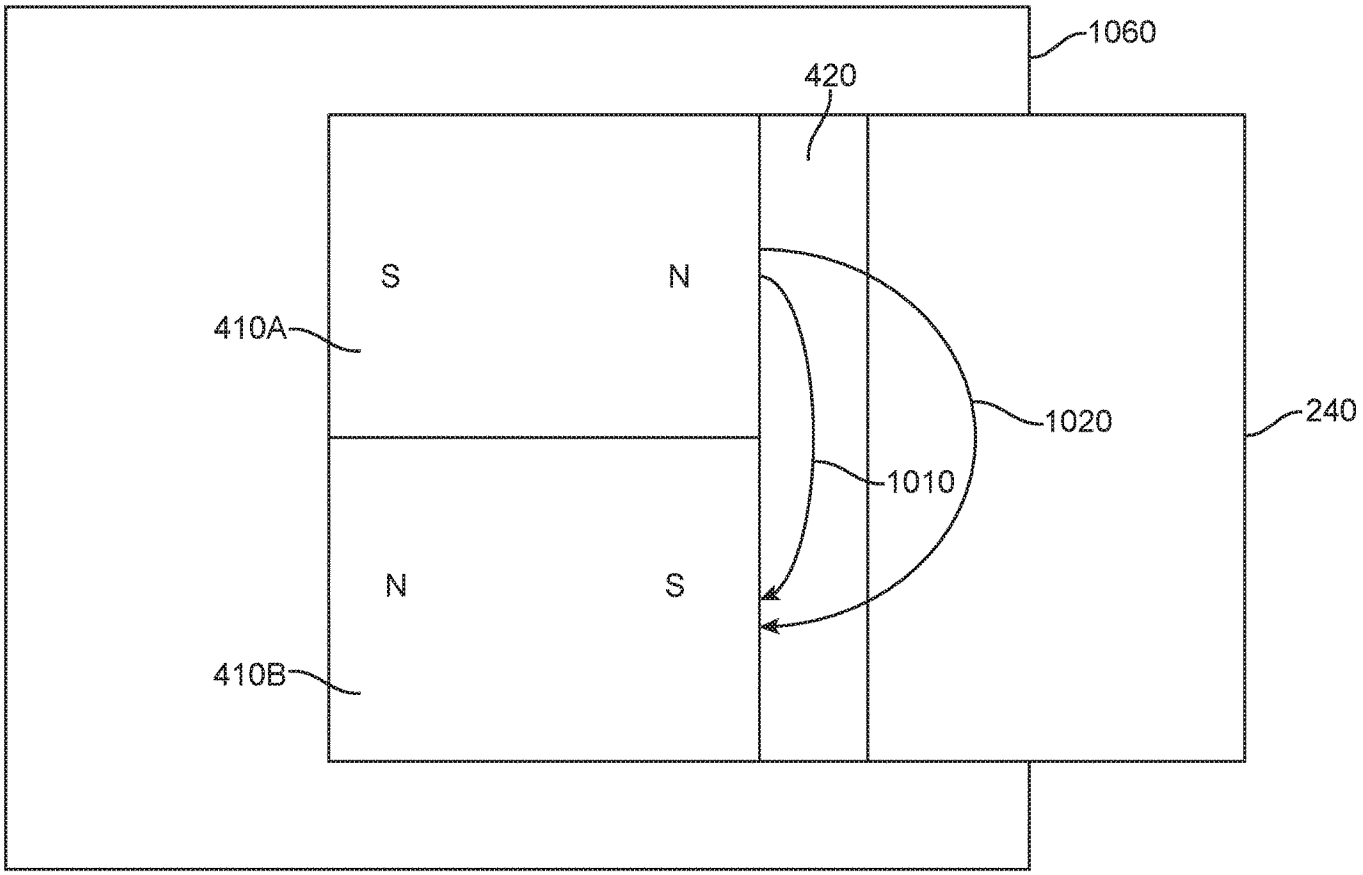

FIGS. 10A and 10B illustrate the operation of a magnetic label according to an embodiment of the present invention. As shown in FIG. 10A, magnetic field lines may originate in a North pole of magnet 410A and terminate in a South pole of magnet 410B. Label 420 may act as a shunt, such that some of the magnetic flux may pass through label 420. That is, label 420 may magnetically saturate. This is shown here as flux 1010. Other portions of the magnetic flux may pass outside of label 420 as stray flux. This is shown here as magnetic flux 1020. Increasing flux 1010 may reduce stray flux 1020. Again, by reducing stray magnetic flux 1020, stray particles may be picked up to a lesser extent, and credit card and other magnetically stored information may be protected. Magnets 410A and 410B may be located in housing 1060. In various embodiments of the present invention, some or all of housing 1060 may be formed with, or part of, device enclosure 210, which encloses an electronic device housing the connector receptacle.

In FIG. 10B, attraction plate 240 may be brought into proximity with label 420. Accordingly, magnetic field lines 1020 pass through attraction plate 240, thereby holding attraction plate 240 in place against label 420. In this way, connector insert 132 may be held in place against connector receptacle 112.

Again, in other embodiments of the present invention, magnetically less conductive portions may be used in label 420. These magnetically less conductive portions may be used to reduce flux 1010. By reducing flux 1010, flux 1020 can be increased, thereby improving the hold power of magnets 410. By increasing the hold power of magnets 410, magnets 410 may be made smaller, less-expensive magnets may be used, the hold power may be increased, or some combination thereof. An example is shown in the following figures.

Figure 11A:
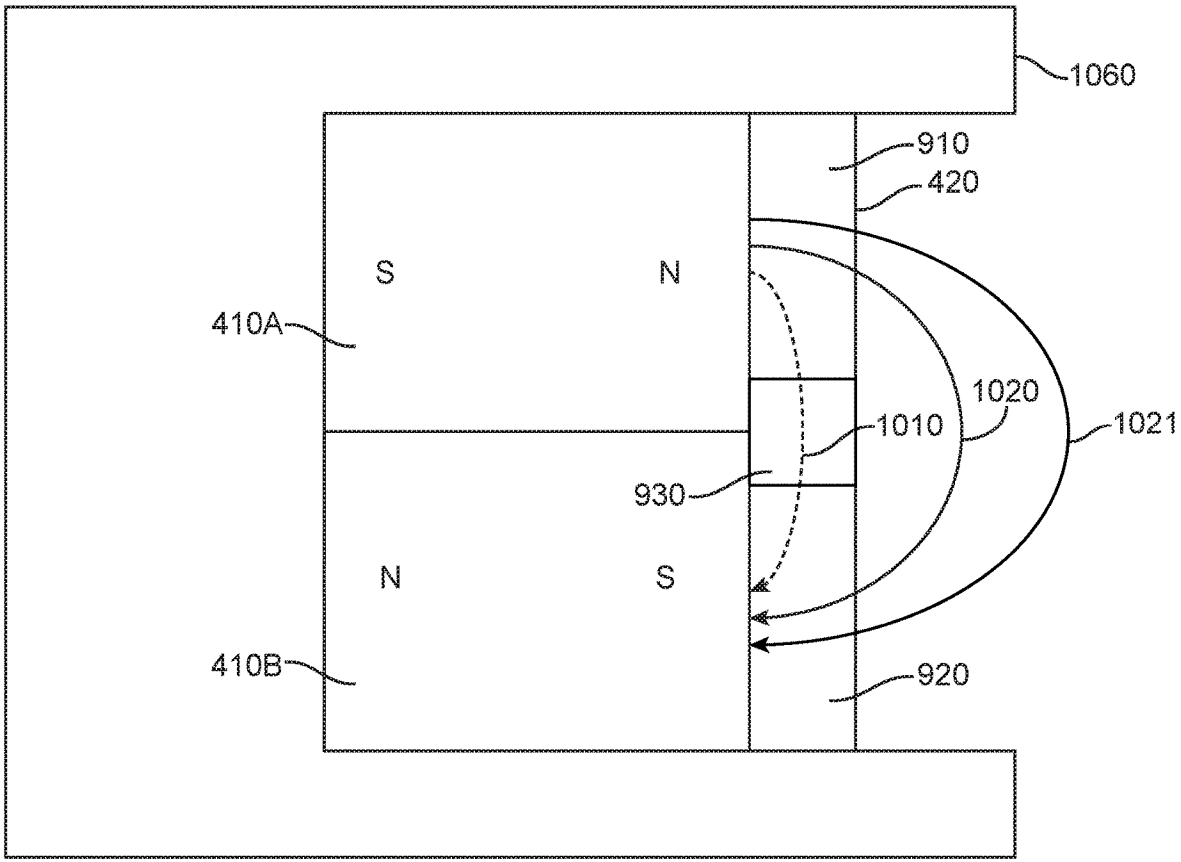
FIGS. 11A and 11B illustrate the operation of a magnetic label according to an embodiment of the present invention.
Figure 11B:
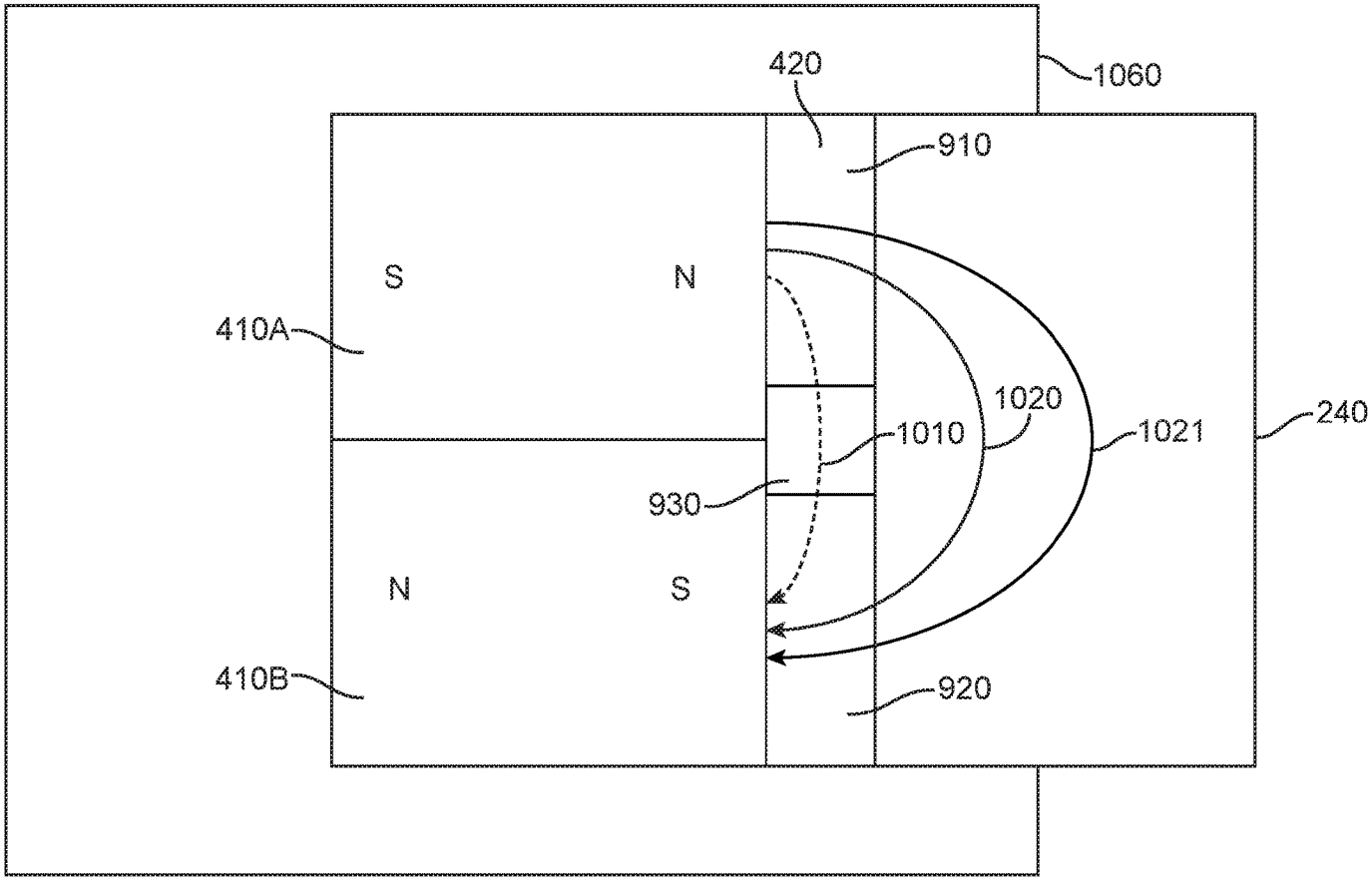

FIGS. 11A and 11B illustrate the operation of a magnetic label according to an embodiment of the present invention. As shown in FIG. 11A, magnetic field lines again may originate in a North pole of magnet 410A and terminate in a South pole of magnet 410B. Because of the presence of magnetically less conductive portion 930, magnetic flux 1010 is reduced. (A dashed line may be used to symbolically indicate this reduction.) For this reason, magnetic flux 1020 is increased (as illustrated here by the inclusion of magnetic field line 1021).

In FIG. 11B, attraction plate 240 may be brought into proximity with label 420. Again, flux lines 1020 and 1021 pass through attraction plate 240. This increased flux 1020 and 1021 increases the hold power of magnets 410A and 410B. This in turn allows magnets 410A and 410B be to be smaller in size, it may allow less expensive magnets to be used, the hold power to be increased, or some combination thereof.

While the above example shows multiple magnets in a receptacle mating with an attraction plate of an insert, in other embodiments of the present invention, other arrangements are possible. For example, the receptacle may include an attraction plate while the insert includes one or more magnets. Further, in other embodiments of the present invention, magnets may be located in both the insert and receptacle.

Again, in other embodiments of the present invention, one magnet may be used in either the receptacle or insert. Magnetic elements may be used to provide magnetic North and South poles at an interface between a receptacle and insert. As before, these magnetic elements may be covered with a label. The label may be fully conductive, or it may be separated by isolation areas to avoid electrical connections between the contacts formed by the magnetic elements. Examples are shown in the following figures.

Figure 12A:
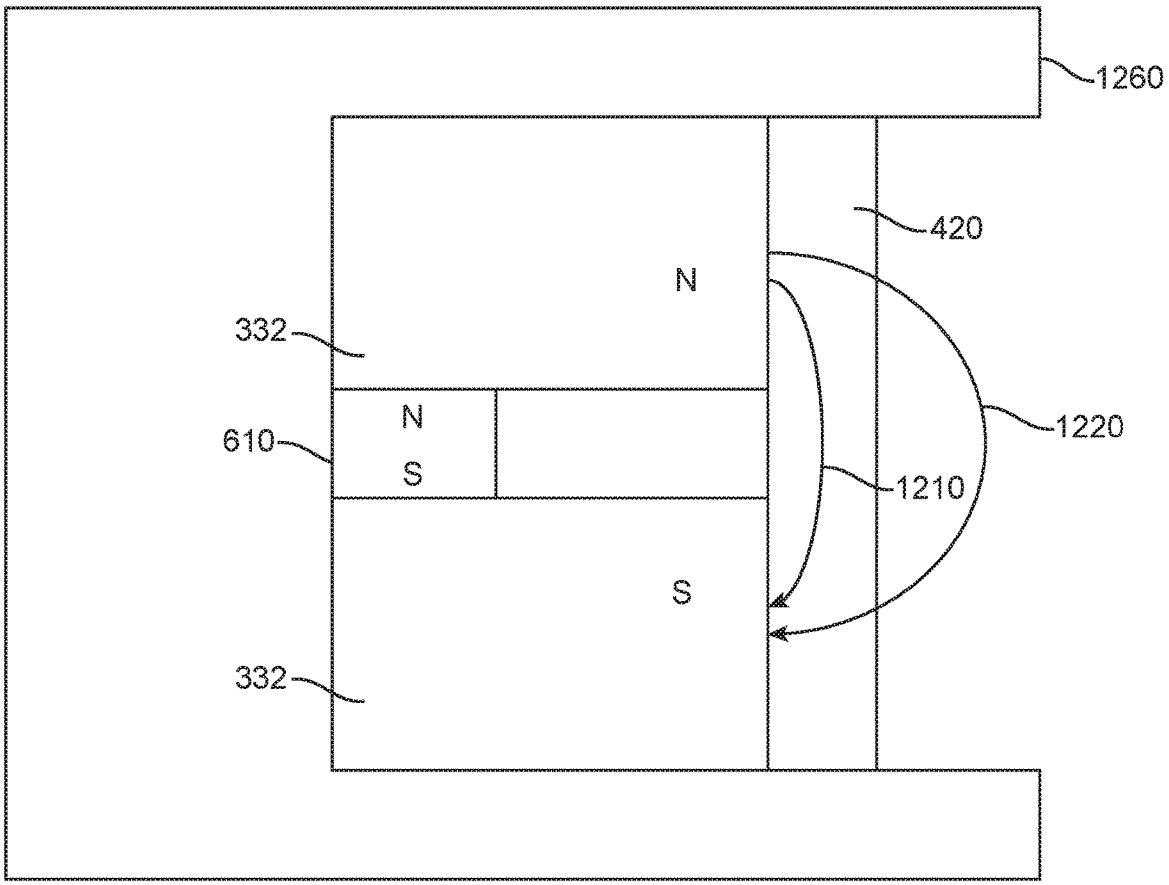
FIGS. 12A and 12B illustrate the operation of a magnetic label according to an embodiment of the present invention.
Figure 12B:
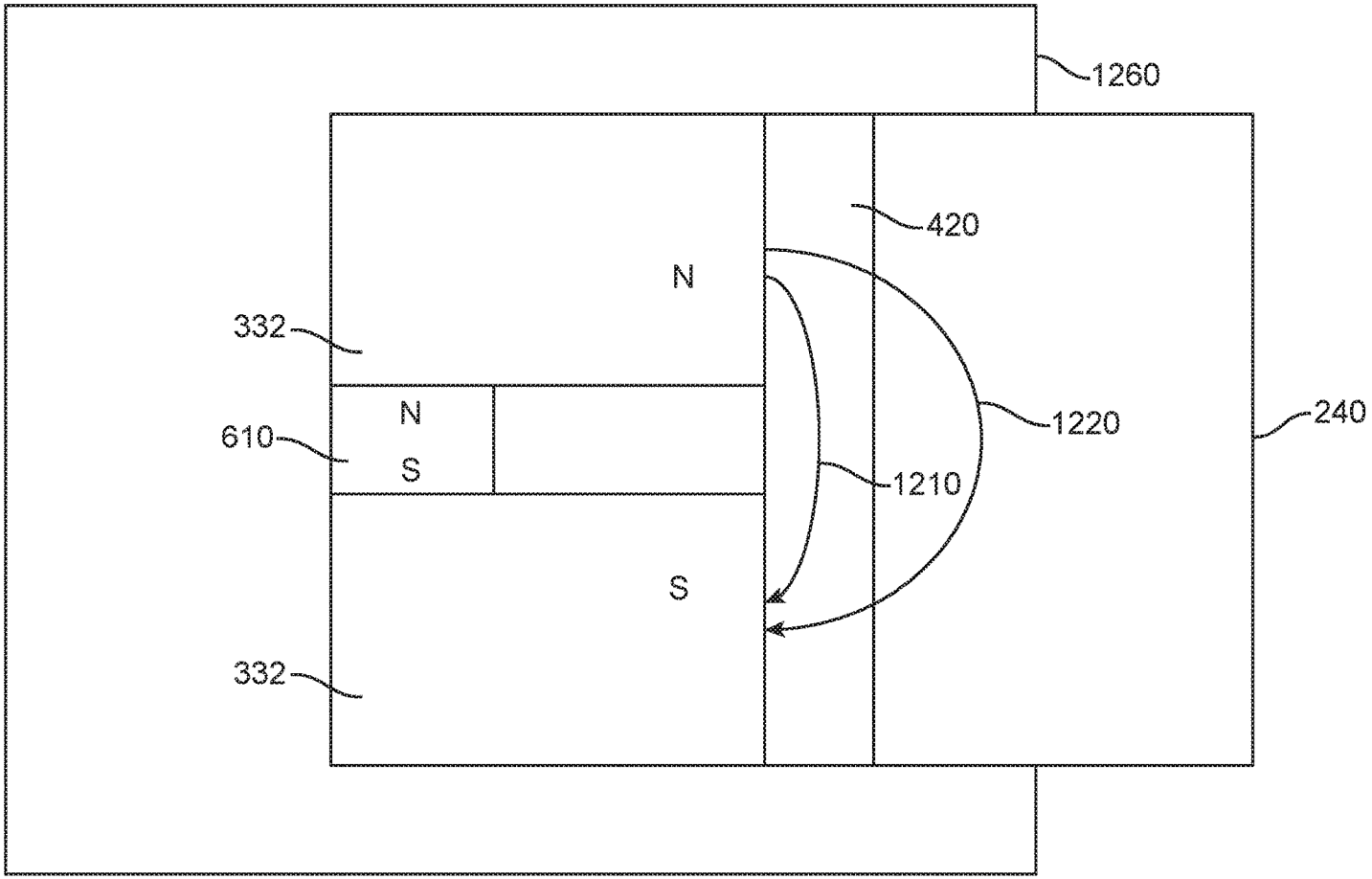

FIGS. 12A and 12B illustrate the operation of a magnetic label according to an embodiment of the present invention. As shown in FIG. 12A, magnetic field lines may originate in a North pole of magnet 610, pass through magnetic elements 332, and terminate in a South pole of magnet 610. Label 420 may act as a shunt, such that some of the magnetic flux may pass through label 420. That is, label 420 may magnetically saturate. This is shown here as flux 1210. Other portions of the magnetic flux may pass outside of label 420 as stray flux. This is shown here as magnetic flux 1220. Increasing flux 1210 may reduce stray flux 1220. Again, by reducing stray magnetic flux 1220, stray particles may be picked up to a lesser extent, and credit card and other magnetically stored information may be protected. Magnet 610 and magnetic elements 332 may be located in housing 1260. In various embodiments of the present invention, some or all of housing 1260 may be formed with, or part of, device enclosure 210, which encloses an electronic device housing the connector receptacle.

In FIG. 12B, attraction plate 240 may be brought into proximity with label 420. Accordingly, magnetic field lines 1220 pass through attraction plate 240, thereby holding attraction plate 240 in place against label 420. In this way, connector insert 132 may be held in place against connector receptacle 112.

Again, in other embodiments of the present invention, magnetically less conductive portions may be used in label 420. These magnetically less conductive portions may be used to reduce flux 1210. By reducing flux 1210, flux 1220 can be increased, thereby improving the hold power of magnet 610. By increasing the hold power of magnet 610, magnet 610 may be made smaller, a less-expensive magnets may be used, the hold power may be increased, or some combination thereof. An example is shown in the following figures.

Figure 13A:
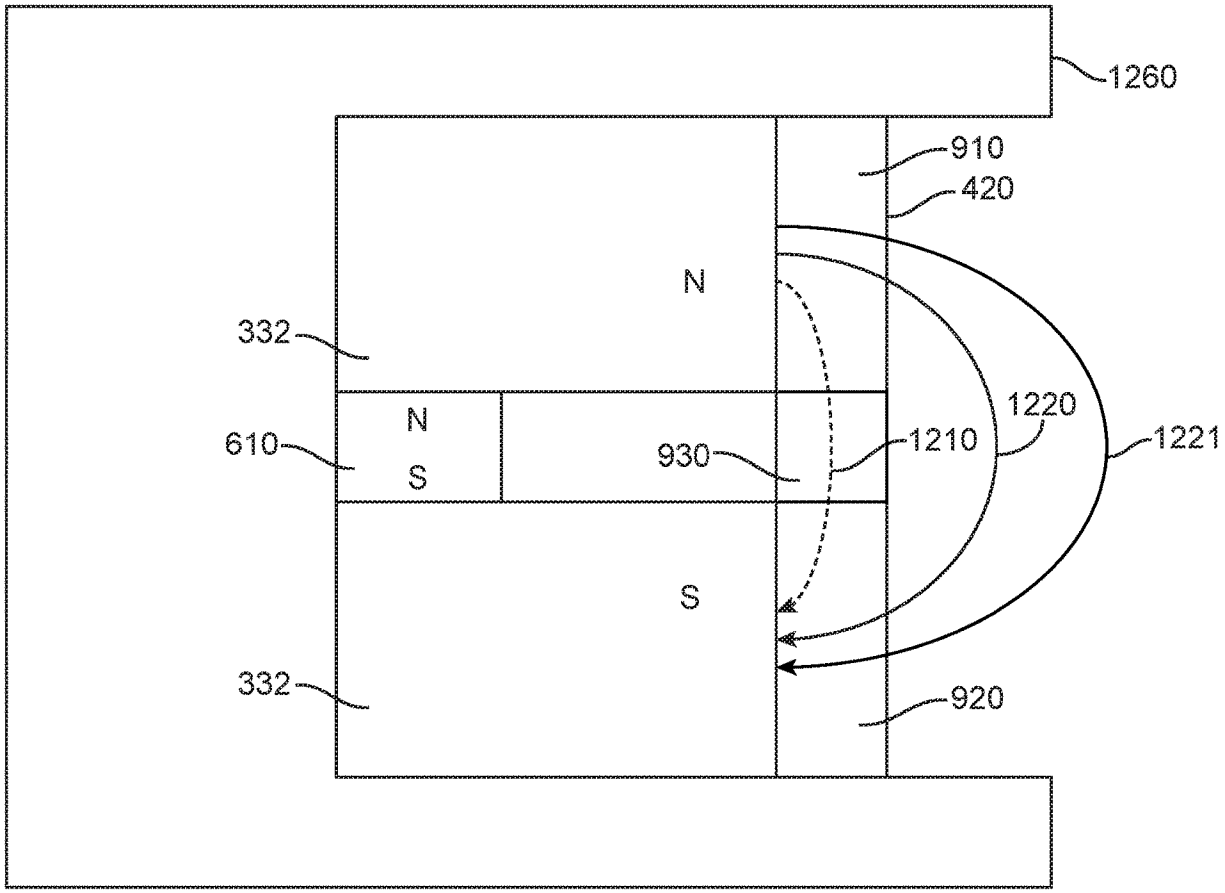
FIGS. 13A and 13B illustrate the operation of a magnetic label according to an embodiment of the present invention.
Figure 13B:
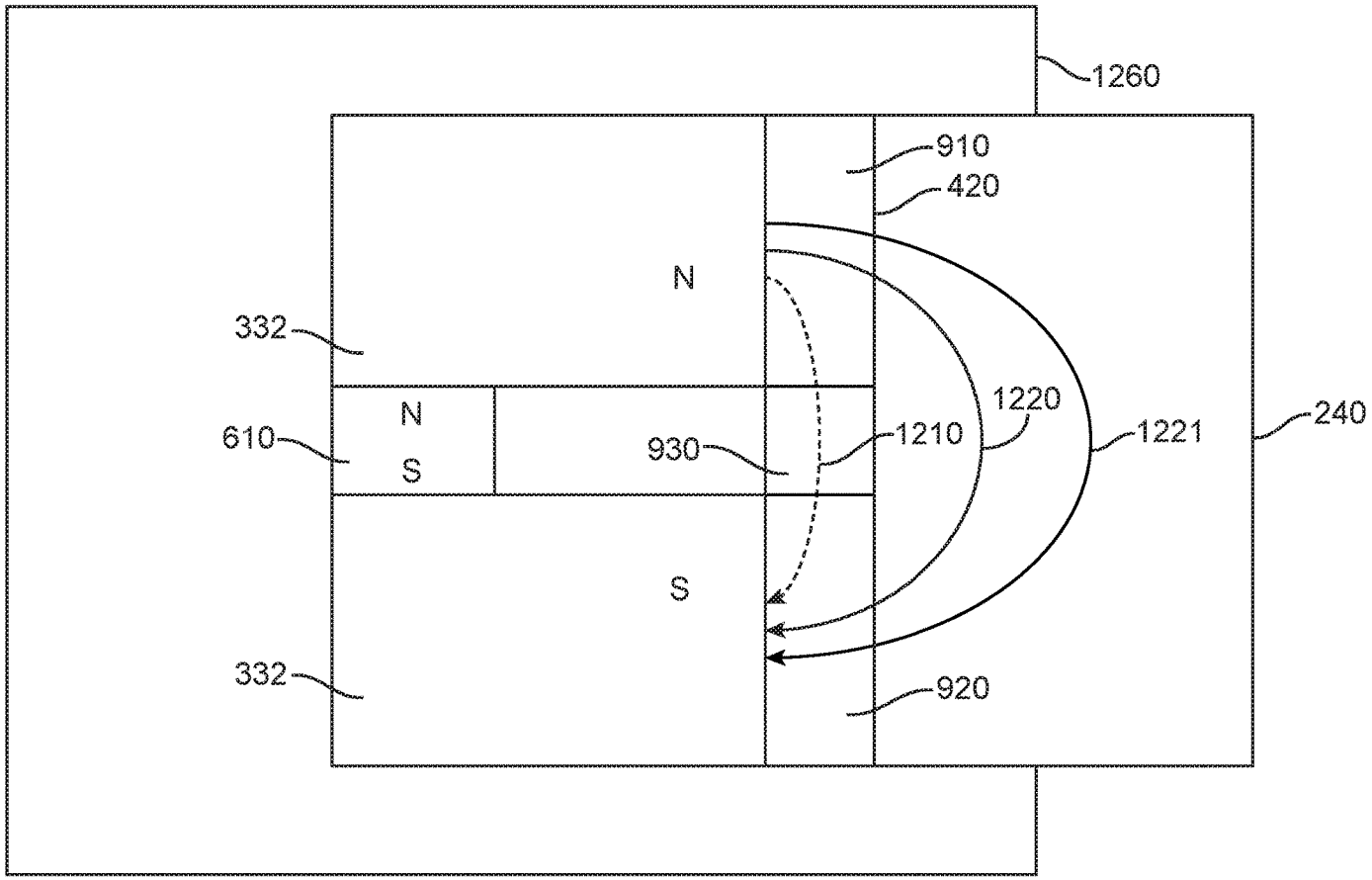

FIGS. 13A and 13B illustrate the operation of a magnetic label according to an embodiment of the present invention. As shown in FIG. 13A, magnetic field lines again may originate in a North pole of magnet 610, pass through magnetic elements 332, and terminate in a South pole of magnet 610. Because of the presence of magnetically less conductive portion 930, magnetic flux 1210 may be reduced. (A dashed line may be used to symbolically indicate this reduction.) For this reason, magnetic flux 1220 is increased (as illustrated here by the inclusion of magnetic field line 1221).

In FIG. 13B, attraction plate 240 may be brought into proximity with label 420. Again, flux lines 1220 and 1221 pass through attraction plate 240. This increased flux 1220 and 1221 increases the hold power of magnet 610. This in turn may allow magnet 610 to be smaller in size, it may allow less expensive magnets to be used, and it may allow the hold power to be increased, or some combination thereof.

In various embodiments of the present invention, label 420 may have various thicknesses. In various embodiments of the present invention where label 420 is a contiguous piece of magnetically conductive material, a thickness of label 420 may be limited such that not all, or an excessive amount, of magnetic flux from magnets 410A and 410B or 610 is shorted through label 420, though label 420 may be thick enough to reduce stray flux. In other words, the label may be thick enough to reduce stray flux, but thin enough to not pass so much of the flux as to weaken the magnetic field beyond a desirable point. With this thickness, the label may be saturated by the magnetic field. In other embodiments of the present invention, label 420 may be thick enough to physically protect magnets 410A and 410B or magnetic elements 332. In a specific embodiment of the present invention, label 420 may have a thickness of 0.2 mm. An additional layer of adhesive may be approximately 0.05 mm thick. In other embodiments of the present invention, other thicknesses may be used. For example, label 420 may be in the range of 0.1 to 0.3 mm thick, though label 420 may be thinner than 0.1 mm or thicker than 0.3 mm.

The above description of embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated. Thus, it will be appreciated that the invention is intended to cover all modifications and equivalents within the scope of the following claims.

What is claimed is:

1. A method of assembling a connector comprising:
providing a first magnet and a second magnet;
orienting the first magnet and the second magnet such that their magnetic field lines are in opposing directions;
placing the first magnet and the second magnet in a housing; and
attaching a label to the first magnet and attaching the label to the second magnet near an opening in the housing such that the label is positioned between the first magnet and a corresponding connector and between the second magnet and the corresponding connector when the connector and the corresponding connector are mated, the label comprising:
a first magnetically conductive portion;
a second magnetically conductive portion;
a magnetically less conductive portion between the first magnetically conductive portion and the second magnetically conductive portion; and
an opening forming a passage through the label.

2. The method of claim 1 wherein attaching the label comprises attaching a label using a layer of adhesive to attach the label to the first magnet and to attach the label to the second magnet.

3. The method of claim 1 wherein the first and second magnetically conductive portions are steel.

4. The method of claim 1 wherein attaching the label comprises attaching a label formed of a resin that contains magnetically conductive particles.

5. The method of claim 1 wherein the first magnetically conductive portion is at least approximately aligned with the first magnet, and the second magnetically conductive portion is at least approximately aligned with the second magnet.

6. The method of claim 5 wherein the label has a thickness between 0.05 and 0.2 mm, such that stray flux is reduced, but a magnetic field at a front of the label is not reduced beyond a desirable level, and the magnets are physically protected.

7. The method of claim 5 wherein the label has a thickness between 0.05 and 0.2 mm.

8. The method of claim 5 wherein the label is formed of resin containing magnetically conductive particles in the first magnetically conductive portion and the second magnetically conductive portion.

9. The method of claim 8 wherein the label has substantially no magnetically conductive particles in the magnetically less conductive portion.

10. The method of claim 1 wherein the label is at least substantially formed of polycarbonate containing iron powder.

11. The method of claim 5 wherein the label is formed of polycarbonate containing iron powder in the first magnetically conductive portion and the second conductive portion.

12. The method of claim 11 wherein the label has substantially no iron powder in the magnetically less conductive portion.

13. The method of claim 5 wherein the label is attached to the first and second magnets by a magnetic field.

14. The method of claim 5 wherein the adhesive is glue.

15. The method of claim 5 wherein the label is attached by being applied as a coating to a surface of the first magnet and the second magnet.

16. The method of claim 5 wherein the first magnetically conductive portion conveys power and the second magnetically conductive portion conveys ground.

17. The method of claim 5 wherein the connector is a receptacle.

18. The method of claim 17 further comprising:

providing a third magnet and a fourth magnet;

orienting the third magnet and the fourth magnet such that their magnetic field lines are in opposing directions;

placing the third magnet and the fourth magnet in the housing.

19. The method of claim 18 wherein attaching the label further comprises attaching the label further comprising:

a third magnetically conductive portion at least approximately aligned with the third magnet, a fourth magnetically conductive portion at least approximately aligned with the fourth magnet; and a second magnetically less conductive portion between the third magnetically conductive portion and the fourth magnetically conductive portion.

20. The method of claim 19 wherein at least one conductive portion may convey power and at least one conductive portion may convey ground.

21. The method of claim 20 wherein at least one conductive portion may convey a signal.

22. A connector comprising:

a first magnet;

a second magnet, the first magnet and the second magnet oriented such that their magnetic field lines are in opposing directions;

a housing supporting the first magnet and the second magnet;

a label attached to the first magnet and the second magnet near an opening in the housing such that the label is positioned between the first magnet and a corresponding connector and between the second magnet and the corresponding connector when the connector and the corresponding connector are mated, the label comprising:

a first magnetically conductive portion;

a second magnetically conductive portion;

a magnetically less conductive portion between the first magnetically conductive portion and the second magnetically conductive portion; and an opening forming a passage through the label.

23. The connector of claim 22 further comprising a layer of adhesive between the label and the first magnet and between the label and the second magnet.

24. The connector of claim 22 wherein the first and second magnetically conductive portions are steel.

25. The connector of claim 22 wherein the label comprises a label formed of a resin that contains magnetically conductive particles.

26. The connector of claim 22 wherein the first magnetically conductive portion is at least approximately aligned with the first magnet and the second magnetically conductive portion is at least approximately aligned with the second magnet.

27. The connector of claim 26 wherein the label has a thickness between 0.05 and 0.2 mm, such that stray flux is reduced, but a magnetic field at a front of the label is not reduced beyond a desirable level, and the magnets are physically protected.

28. The connector of claim 26 wherein the label has a thickness between 0.05 and 0.2 mm.

29. The connector of claim 26 wherein the label is formed of resin containing magnetically conductive particles in the first magnetically conductive portion and the second magnetically conductive portion.

30. The connector of claim 29 wherein the label has substantially no magnetically conductive particles in the magnetically less conductive portion.

31. The connector of claim 22 wherein the label is at least substantially formed of polycarbonate containing iron powder.

32. The connector of claim 26 wherein the label is formed of polycarbonate containing iron powder in the first magnetically conductive portion and the second conductive portion.

33. The connector of claim 32 wherein the label has substantially no iron powder in the magnetically less conductive portion.

34. The connector of claim 26 wherein the label is attached to the first and second magnets by a magnetic field.

35. The connector of claim 26 wherein the label is glued to the first and second magnets by a layer of adhesive.

36. The connector of claim 26 wherein the label is attached by being applied as a coating to a surface of the first magnet and the second magnet.

37. The connector of claim 26 wherein the first magnetically conductive portion conveys power and the second magnetically conductive portion conveys ground.

38. The connector of claim 26 wherein the connector is a receptacle.

39. The connector of claim 38 further comprising:

a third magnet and a fourth magnet oriented such that their magnetic field lines are in opposing directions, wherein the third magnet and the fourth magnet are supported by the housing.

40. The connector of claim 39 wherein the label further comprises:

a third magnetically conductive portion at least approximately aligned with the third magnet, a fourth magnetically conductive portion at least approximately aligned with the fourth magnet; and a second magnetically less conductive portion between the third magnetically conductive portion and the fourth magnetically conductive portion.

41. The connector of claim 40 wherein at least one conductive portion may convey power and at least one conductive portion may convey ground.

42. The connector of claim 41 wherein at least one conductive portion may convey a signal.

43. The connector of claim 26 wherein the opening is located between the first magnetically conductive portion and the second magnetically conductive portion of the label.

44. The connector of claim 43 further comprising a plurality of contacts, wherein the opening allows access to the contacts by the corresponding connector.

45. A connector comprising:

a first magnet;

a second magnet, the first magnet and the second magnet oriented such that their magnetic field lines are in opposing directions;

a housing supporting the first magnet and the second magnet;

a label attached to the first magnet and the second magnet near an opening in the housing such that the label is positioned between the first magnet and a corresponding connector and between the second magnet and the corresponding connector when the connector and the corresponding connector are mated, the label comprising:

a first magnetically conductive portion;

a second magnetically conductive portion separate from the first magnetically conducive portion; and a magnetically less conductive portion between and separating the first magnetically conductive portion and the second magnetically conductive portion.

* * * * *